US006026865A

United States Patent [19]

Krumm et al.

[11] Patent Number: 6,026,865

[45] Date of Patent: Feb. 22, 2000

[54] AXIALLY SLIDABLE WEFT THREAD PRESENTING LEVERS AND CLAMPING ARRANGEMENT FOR MINIMIZING THREAD WASTE

[75] Inventors: Valentin Krumm, Hergensweiler; Horst Haeussler, Lindau; Stephan Arndt, Lindau-Bodolz; Siegbert Gsell, Wangen; Peter Schiller, Lindau; Herbert Mueller, Kressbronn, all of Germany

[73] Assignee: Lindauer Dornier Gesellschaft mbH, Lindau, Germany

[21] Appl. No.: 09/150,355

[22] Filed: Sep. 9, 1998

[30] Foreign Application Priority Data

Sep. 11, 1997 [DE] Germany ..... 197 39 853
Mar. 2, 1998 [DE] Germany ..... 298 03 573 U

[51] Int. Cl.[7] ..... D03D 47/38; D03D 47/34

[52] U.S. Cl. ..... 139/453

[58] Field of Search ..... 139/453

[56] References Cited

U.S. PATENT DOCUMENTS

| | | | |
|---|---|---|---|
| 4,160,468 | 7/1979 | Camprubi | 139/453 |
| 4,785,856 | 11/1988 | Gehring et al. . | |
| 5,694,892 | 12/1997 | Debaes | 139/453 |

FOREIGN PATENT DOCUMENTS

| | | |
|---|---|---|
| 0240075 | 10/1987 | European Pat. Off. . |
| 0310767 | 4/1989 | European Pat. Off. . |
| 0467059 | 1/1992 | European Pat. Off. . |
| 0644286 | 3/1995 | European Pat. Off. . |
| 2466548 | 9/1979 | France . |
| 2531954 | 2/1976 | Germany . |
| 3042053 | 11/1982 | Germany . |
| 3618445 | 7/1987 | Germany . |
| 4325905 | 10/1994 | Germany . |
| 297 16 310 U | 5/1998 | Germany . |

*Primary Examiner*—Andy Falik
*Attorney, Agent, or Firm*—W. F. Fasse; W. G. Fasse

[57] ABSTRACT

A controlled weft thread presenting and clamping arrangement minimizes weft thread waste and ensures proper tensioning of the weft thread during its presentation to the insertion gripper, in a gripper loom for weaving with plural different weft threads. The arrangement includes a control shaft (13) that has a drive key (14) protruding therefrom in a reference plane (7), and that is rotatably supported on a support bracket (10, 11, 12), which may be mounted on the loom. Weft thread presenting levers (15) each carrying a respective clamp (16) are movably arranged on the shaft (13), which passes through a hole in each of the presenting levers (15). A translational drive (22) acts on a presenting lever support (17) to translationally move all of the presenting levers (15) in unison together axially along the shaft (13) until a selected lever (15) is positioned in the reference plane (7), with the lever's drive groove 15B engaged on the drive key (14) of the shaft (13). A rotational drive (23) rotates the shaft (13), and therewith the selected thread presenting lever (15) via the drive key (14). A guide member (19) has a lengthwise groove (20) to allow all of the presenting levers (15) to move linearly therealong in unison, and a crosswise groove (21) in the reference plane (7) to allow only the selected presenting lever (15) to rotate in the reference plane. A thread back tensioning device (9) is arranged in the thread path to apply tension to the thread being presented to the gripper.

29 Claims, 7 Drawing Sheets

AXIALLY SLIDABLE WEFT THREAD PRESENTING LEVERS AND CLAMPING ARRANGEMENT FOR MINIMIZING THREAD WASTE

PRIORITY CLAIM

This application is based on and claims the priority under 35 U.S.C. §119 of German Patent Application 197 39 853.7-26, filed on Sept. 11, 1997, and German Utility Model Application 298 03 573.1, filed on Mar. 2, 1998. The entire disclosures of German Patent Application 197 39 853.7-26 and German Utility Model Application 298 03 573.1 are incorporated herein by reference.

FIELD OF THE INVENTION

The invention relates to a controllable apparatus for feeding or presenting a clamped weft thread to a thread insertion gripper, and the arrangement of at least one weft thread back tensioning device cooperating with the controllable apparatus, whereby the weft thread presenting and clamping apparatus serves to minimize the weft thread waste during production of a woven web on a gripper loom, and the at least one weft thread back tensioning device tensions the weft thread during the thread presentation phase.

BACKGROUND INFORMATION

In order to minimize the weft thread waste, published European Patent Application 0,240,075 (Moenclaey et al.) discloses a method and an apparatus for carrying out the method, wherein at least two weft thread supply arrangements are used, and at least two weft threads are presented, clamped and fastened, for forming the woven web. The method can essentially be characterized as follows. The free ends of at least first and second weft threads that are to be successively inserted into a loom shed are clampingly held, each respectively in a respective moving clamp on a thread presenting lever arm of a thread presenting and clamping arrangement. At this time, the lever arms are located in a first position A. Next, a weft thread selector selects a single weft thread from the two weft threads, for presentation to an insertion gripper. The corresponding thread presenting lever arm is moved into a second position B and thereby brings the selected weft thread into the path of the insertion gripper, which in turn takes over the selected weft thread. Thereafter, the thread presenting lever arm is moved into a position C, located near the insertion side web edge along the continuation of the line of the beat-up edge of the woven web. After it is inserted into the loom shed and bound-in, the above mentioned weft thread, which remains connected with the thread supply, is held clamped by the corresponding clamp in the position C. Next, the bound-in weft thread is cut from the clamped weft thread that is held ready and connected to the thread supply, by means of a weft thread cutter, between the web edge and the clamp located in position C. After the weft thread has been cut off, the corresponding thread pre senting lever arm is moved back into the position A or is main tained in the position C.

The above described known method, as well as the associated apparatus for carrying out the method as will be described below, suffer the grave disadvantage that the different weft thread types that are to be inserted necessarily respectively have different thread waste end lengths. Namely, since the several thread clamps respectively holding the different weft thread types are arranged laterally adjacent one another spaced from the woven web edge, the amount of thread waste will necessarily differ among the threads held in the different clamps. Thus, while the thread clamp positioned closest to the web edge will realize a relatively small thread waste length, the thread waste lengths of the weft threads held by the remaining thread clamps will be successively comparatively greater. This successive increase of the thread waste length is necessitated by the arrangement of the apparatus, and is a significant disadvantage, making it impossible to truly minimize the total thread waste, and resulting in different amounts of waste from the respective different thread supply spools.

To further describe the above mentioned disadvantage, the prior apparatus according to published European Patent Application 0,240,075 will now be briefly discussed. The known apparatus for presenting and clamping weft threads in a gripper loom essentially comprises a respective thread presenting lever arm with a corresponding thread clamp for each weft thread type that is to be inserted into the loom shed. The thread presenting lever arms are arranged respectively adjacent to one another approximately parallel to the insertion-side web edge. Thereby the clamp of the first thread presenting lever is positioned closest to the web edge in the positions A and C, while the clamp of the last thread presenting lever is positioned farthest away from the web edge. From this arrangement it becomes clear that the free thread length between the fixed position of the thread cutter at the woven web edge and each of the clamps following the first clamp must be regarded as a further disadvantage. Namely, as the thread length between the thread cutter and the respective thread clamp becomes greater, generally the thread tension in the thread, as is necessary for carrying out the cutting, will become smaller. In this regard, the known apparatus cannot ensure that all of the weft threads will be properly cut to form a regular cut edge along the insertion side of the loom shed.

German Patent Laying-Open Document 2,531,954 discloses a controllable weft thread clamping arrangement with a plurality of clamping members, whereby each clamping member is slideably displaceable relative to a reference plane, and whereby further the clamping members are arranged above one another at respective constant uniform spacings. With this known arrangement, respectively one clamping member can be slidingly displaced into the reference plane at a time. This clamping arrangement is provided in combination with generally known controlled weft thread selectors, in other words, each clamping member of the controlled clamping arrangement is correspondingly associated with a respective controlled weft thread selector as required by the functioning of the apparatus.

In this manner, the known arrangement according to German Patent Laying-Open Document 2,531,954 achieves the advantage that the respective weft thread to be inserted into the loom shed can be moved into a first reference plane, where the respective weft thread is taken over by the insertion gripper without problems. On the other hand, the respective clamping member can be moved into a second reference plane, which corresponds to the position of the binding point or binding edge of the woven web. Hereby it is achieved that the weft thread is held by the respective corresponding clamping member of the clamping arrangement while the weft thread is being beat-up against the binding edge of the woven web, and the respective weft thread is held under tension on the insertion side of the loom shed between the web edge and the clamping location. This is advantageous for carrying out the cutting process, which is achieved by the thread cutter arranged between the clamping location and the web edge. However, it is not possible to absolutely minimize the weft thread waste with this arrangement, because the weft threads cannot be directly presented to the insertion gripper.

Furthermore, published European Patent Application 0,644,286 (Stacher et al.) discloses a controllable weft thread clamping arrangement including a plurality of clamping members, of which the structure and function essentially corresponds to that disclosed in the above described German Patent Laying-Open Document 2,531,954. This reference provides no further disclosure or suggestions toward minimizing the weft thread waste.

SUMMARY OF THE INVENTION

In view of the above, it is an object of the invention to provide a weft thread presenting and clamping arrangement in connection with further associated mechanisms, with which it is possible to minimize the weft thread waste, while further ensuring that the weft thread will be sufficiently held under tension especially in the phase of presenting the weft thread to the insertion gripper. The invention further aims to avoid or overcome the disadvantages of the prior art, and to achieve additional advantages, as apparent from the present description.

The above objects have been achieved in a controllable weft thread feeding or presenting and clamping arrangement according to the invention, comprising a support bracket that can be mounted on a loom, a control shaft that has a driving key on its circumference in a reference plane and that is rotatably supported between first and second bracket arms projecting from the support bracket, and a plurality of weft thread presenting levers arranged one above another and carrying respective thread clamps, whereby the weft thread presenting levers are translationally movable with a presenting lever support along the control shaft between the projecting arms of the support bracket. Both the presenting lever support as well as the plural weft thread presenting levers are arranged on the adjusting shaft, which passes respectively therethrough. A guide member provided on the support bracket has a lengthwise groove therein for guiding all of the weft thread presenting levers and the presenting lever support, as well as a crosswise groove intersecting the lengthwise groove in the reference plane for respectively guiding a respective selected one of the weft thread presenting levers. The arrangement further comprises a first drive for translationally moving the presenting lever support in order to respectively move one of the weft thread presenting levers along the control shaft into the reference plane, and a second drive for rotationally moving the control shaft in order to pivot the respective weft thread presenting lever in the reference plane.

The above objects have further been achieved in an arrangement according to the invention, for minimizing the waste of weft rho threads that are to be inserted into the loom shed of a loom, and particularly a gripper loom, including an insertion gripper and a receiver gripper, a plurality of weft thread supply devices, a weft thread selector arrangement including a plurality of weft thread selector needles, a controllable weft thread presenting and clamping arrangement that includes a plurality of weft thread presenting levers with respective thread clamps, whereby each weft thread selector needle is functionally associated with one of the weft thread presenting levers with its respective clamp, and further including a weft thread cutter arranged on the insertion side of the loom shed. Particularly according to the invention, the weft thread presenting levers are respectively embodied as tiltable or pivotable levers, whereby each weft thread presenting lever can be selectively moved into the reference plane by vertical sliding displacement, and can then be pivotally rotated from a first position A into a second position B that is close to the insertion gripper by means of rotation in the reference plane. Furthermore, at least one weft thread back tensioning device or so-called take-up sweep device is arranged in the path of the weft thread between each weft thread presenting lever with its respective clamp and each weft thread supply device, in order to pull back and apply tension to the respective weft thread presented to the insertion gripper.

A significant feature of the inventive apparatus is that it comprises a particular structure and arrangement of weft thread presenting levers with respective thread clamps, and is arranged in the loom in combination and cooperation with at least one weft thread back tensioning device, in such a manner so as to realize a minimum of weft thread waste for all of the weft threads that are to be inserted into the loom shed in a predetermined sequence.

The inventive combination of the weft thread presenting and clamping arrangement with the at least one weft thread back tensioning device arranged in the thread running path between the weft thread supply and the weft thread presenting and clamping arrangement, achieves the advantage that a respective weft thread is pulled back and thereby subjected to the desired tension force at least during the phase of presenting the respective weft thread to the insertion gripper, by using appropriate control techniques. Such an controlled tension of the weft thread is especially necessary for ensuring a reliable transfer of the thread to the insertion gripper. It should be understood that an electronic loom control is used for carrying out the complex process sequence including steps of selecting the respective weft thread by the weft thread selector arrangement, presenting the selected weft thread to the insertion gripper and temporarily holding this thread under tension during the thread presentation, and finally clamping the new weft thread and cutting it from the previously inserted weft thread.

BRIEF DESCRIPTION OF THE DRAWINGS

In order that the invention may be clearly understood, it will now be described in connection with example embodiments, with reference to the accompanying drawings, wherein.

DESCRIPTION OF PREFERRED EXAMPLE EMBODIMENTS AND OF THE BEST MODE OF THE INVENTION

Figure 1:
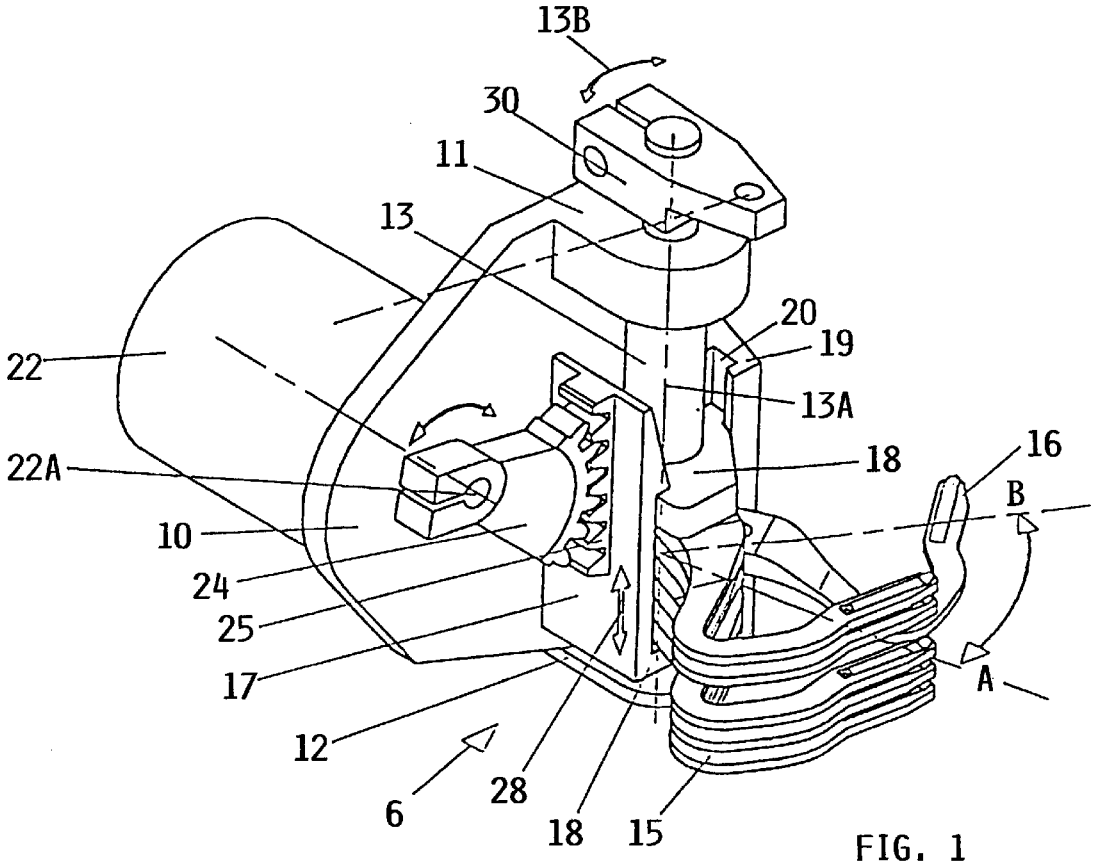
FIG. 1 is a schematic perspective view of the inventive controllable weft thread presenting and clamping arrangement with a first drive embodiment for driving the thread presenting levers.

FIG. 1 shows the general structure of the weft thread presenting and clamping arrangement 6 according to the invention, including a plurality of weft thread feeders or presenting levers 15. On a free end of each thread presenting lever 15 is arranged a respective thread clamp 16 for clampingly receiving the end of a weft thread 3 that is to be presented to an insertion gripper 2, as also further shown in FIGS. 4, 5 and 9.

Figure 1A:
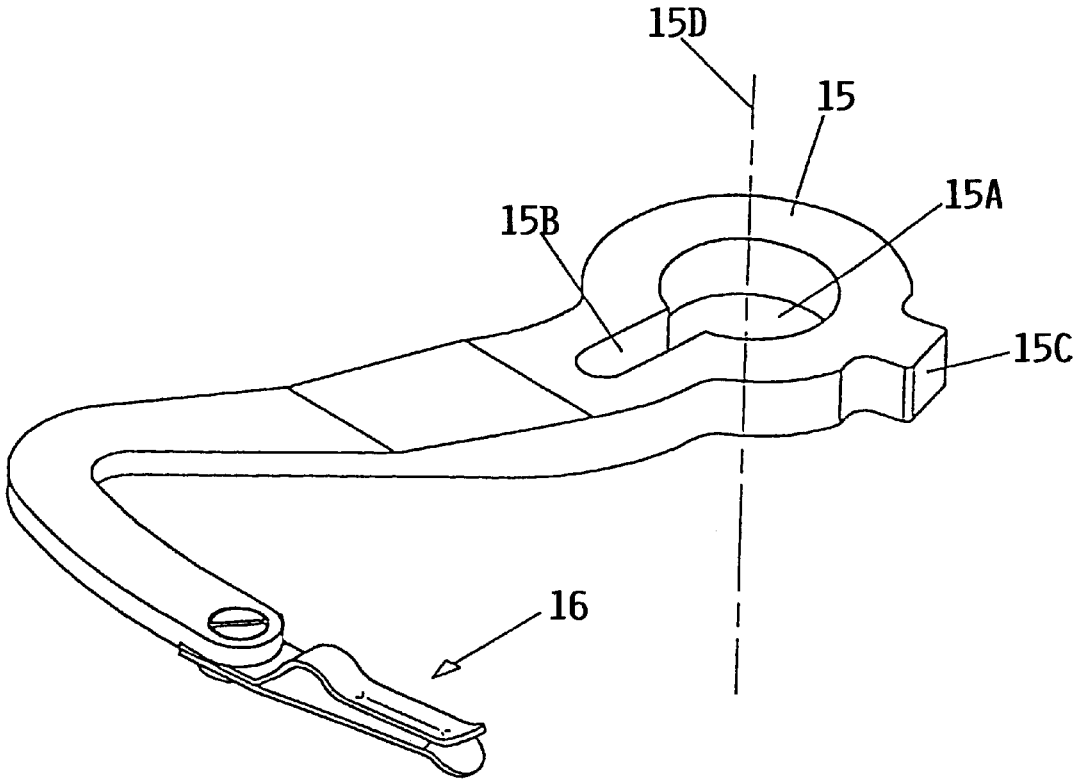
FIG. 1A is an enlarged perspective view of a single thread presenting lever.

As shown particularly in FIG. 1A, the other end of each thread presenting lever 15 has a through-hole 15A extending therethrough in the direction of the lengthwise axis 15D, with a groove l5B extending through the thread presenting lever 15 parallel to the lengthwise axis 15D and adjoining the throughhole 15A over the axial length thereof. Also at this end of the respective thread presenting lever 15, a guide lug 15C protrudes radially outwardly from the outer circumference of this end of the lever at a location angularly offset from the groove 15B, while extending parallel to the lengthwise axis 15D. Each lever 15, and particularly the free end thereof carrying the clamp 16 has a curving sickle shape when viewed in a direction along the axis 15D.

Figure 1B:
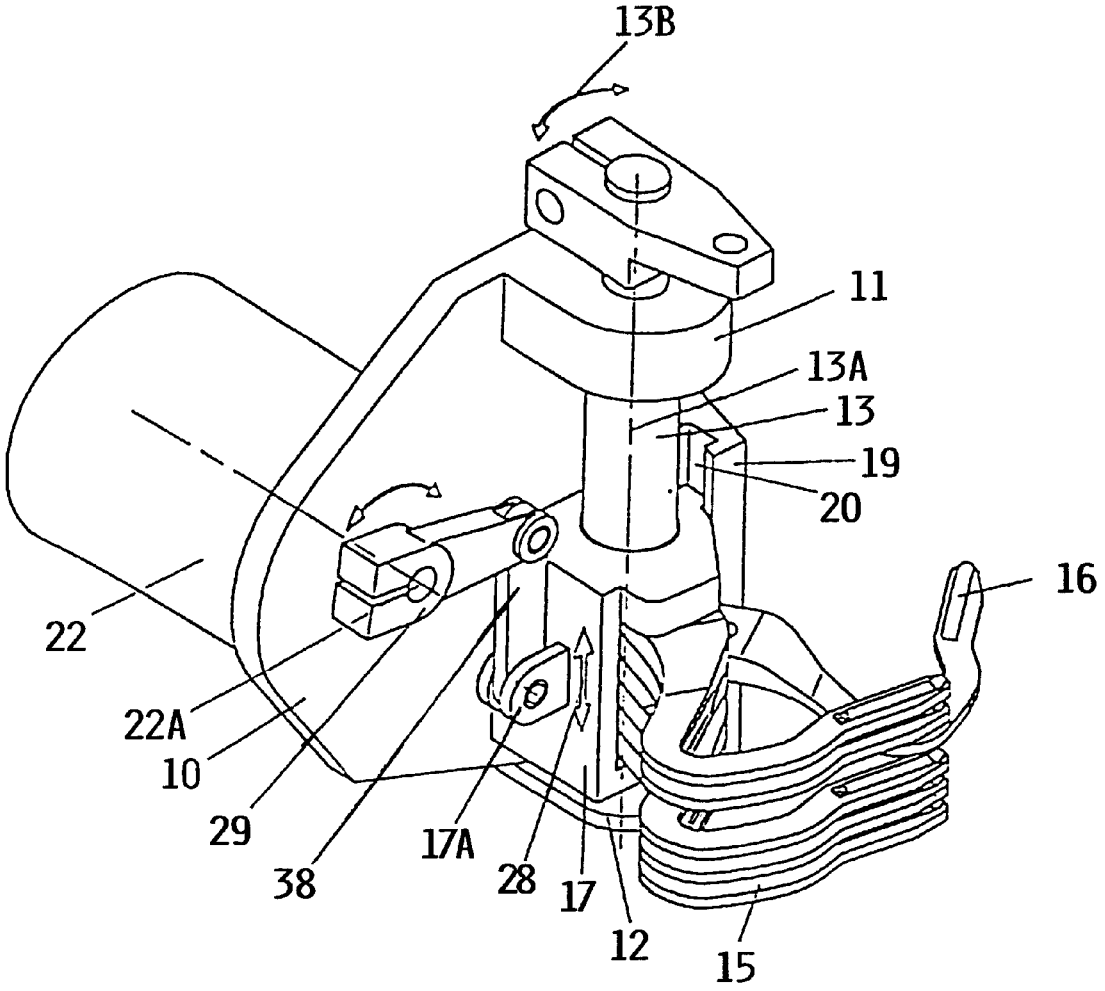
FIG. 1B is a perspective view of a controllable weft thread presenting and clamping arrangement similar to that of FIG. 1, but with a second drive embodiment for driving the thread presenting levers.

A plurality of the thread presenting levers 15 as shown in FIG. 1A are arranged on an adjusting shaft or control shaft 13, with the shaft 13 respectively passing through the holes 15A in such a manner that all of the presenting levers 15 together can be translationally displaced in a direction parallel to the central axis 13A of the shaft 13 along the outer circumferential surface of the shaft 13, as shown in FIGS. 1 and 1B for example. For this purpose, the levers 15 as well as a motion limit stop member 18 are preferably held or clasped together by a lever support 17, which is also arranged to be slidable along the shaft, which passes through a hole in the support 17. The shaft 13 is arranged between a first projecting member or bracket arm 11 and a second projecting member or bracket arm 12 of a support bracket 10 and is supported thereby to be rotatable about its axis 13A.

In this context, the projecting members 11 and 12 protrude perpendicularly away from the major plate body of the support bracket 10 in the manner of a bracket arm.

Figure 3:
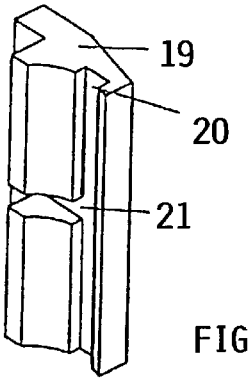
FIG. 3 is a detailed view of a guide member having lengthwise and crosswise grooves therein.
Figure 8:
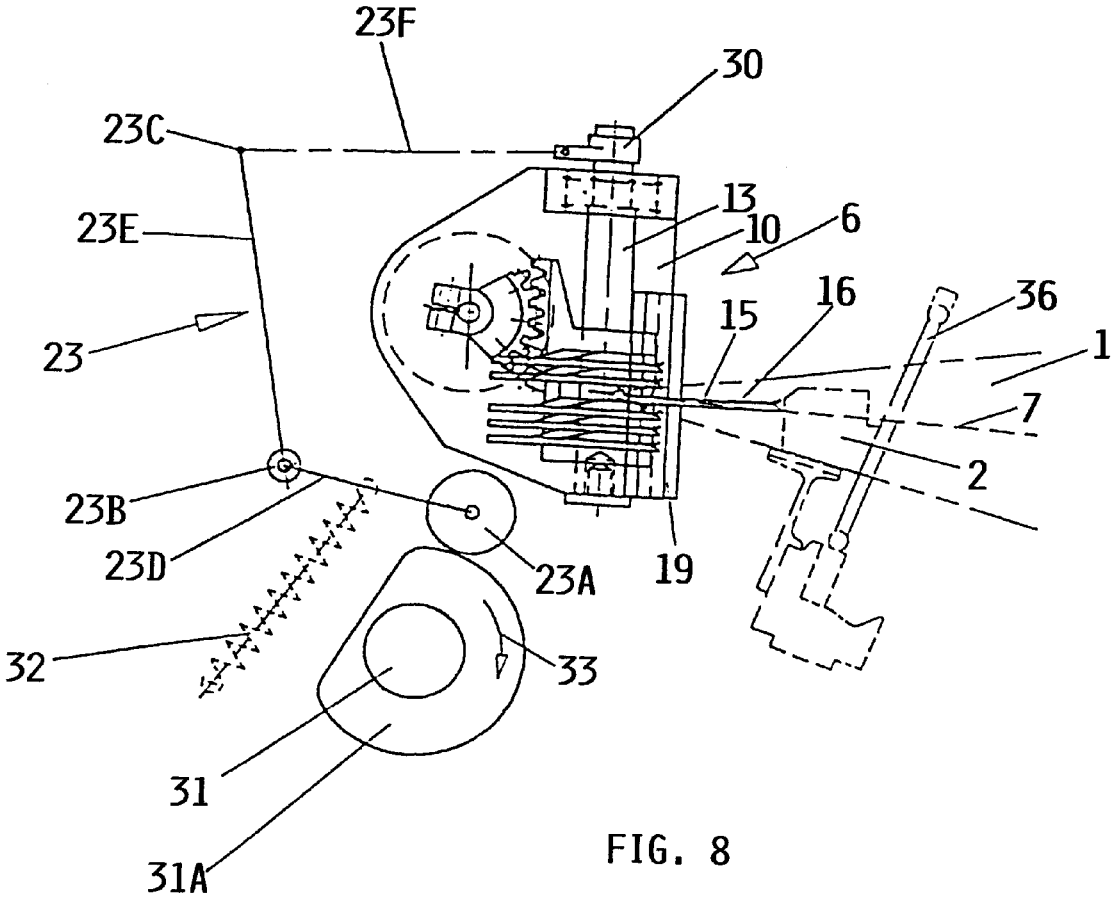
FIG. 8 is a schematic front view of the weft thread presenting and clamping arrangement according to the invention, with a different embodiment of the drive for the pivoting movement of the weft thread presenting levers, whereby the drive power is derived or taken-off from the loom drive.

Further according to FIG. 1, and as shown separately in detail in FIG. 3, the arrangement 6 further includes a sectionally profiled guide member 19 having a lengthwise groove 20 extending therealong parallel to the central axis 13A of the shaft 13, and a crosswise groove 21 therein extending perpendicularly to and intersecting the lengthwise groove 20. The crosswise groove 21 lies on a plane that is designated as the reference plane 7, as shown in FIG. 8. In this context, the reference plane 7 is the plane in which the insertion gripper 2 receives or takes over the weft thread 3 presented by the weft thread presenting lever 15 for inserting the respective weft thread 3 into a loom shed 1. The guide member 19 is rigidly connected to the support bracket 10 in any suitable manner, for example by bolts or by being formed as an integral protruding part of the support bracket 10, for example.

Figure 2:
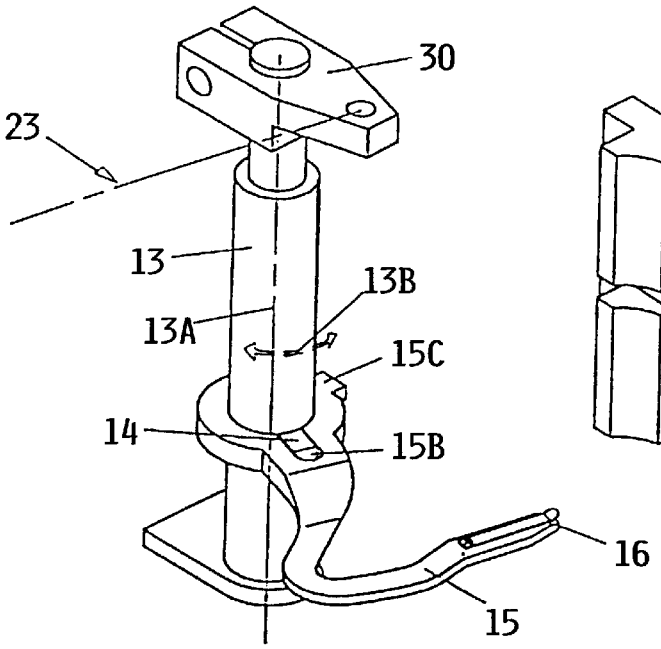
FIG. 2 is a perspective view of a partial assembly of the arrangement according to the invention, showing a weft thread presenting lever arranged on the control shaft and engaging the drive key of the shaft.

As shown particularly in FIG. 2, a drive key 14, which may be any protrusion, cam, dog, spline or the like, is arranged protruding from the outer circumference of the shaft 13 in the reference plane 7. This drive key 14 serves to engage and rotationally drive a selected respective one of the thread presenting levers 15 that has been moved into the reference plane 7 as will now be described.

As shown in FIG. 1, the inventive arrangement 6 further includes a drive, that, for example comprises an electric motor 22 driving a rotatable shaft 22A, which in turn drives a toothed gear sector 24 mounted on the shaft 22A. The toothed gear sector 24 engages a toothed rack 25 provided on the presenting lever support 17, so that a rotational movement of the shaft 22A is translated into a vertical sliding displacement of the presenting lever support 17 in the direction of the double-headed arrow 28, whereby the presenting lever support 17 moves all of the levers 15 vertically in unison until a particular selected lever 15 is moved into a position corresponding to the respective reference plane 7. In this position, the respective selected presenting lever 15 slides onto the drive key 14 of the control shaft 13 such that the drive key 14 engages the groove 15B of the respective presenting lever 15. The operation of the motor or other primary driver 22 is controlled by a control program being executed by the loom control.

As an alternative to the drive mechanism shown in FIG. 1, FIG. 1B shows a bellcrank linkage drive mechanism for converting the rotational motion of the drive motor 22 with shaft 22A into a linear sliding motion 28. The motor 22 is preferably embodied as an electric stepper motor, with a one-armed lever 29 mounted on the shaft 22A. A coupling rod 38 is connected to the free end of the one-armed lever 29 and to the free end of a connection part or lug 17A provided on the presenting lever support 17 in the form of another one-armed lever. In this manner, the first lever 29 rotates or pivots with the shaft 22A, and through the coupling rod 38, transmits the rotating or pivoting motion in the form of a linear motion 28 to the presenting lever support 17, which correspondingly moves the presenting levers 15 vertically along the shaft 13, until the selected presenting lever 15 is positioned in the reference plane 7 and engages the drive key 14 into its groove 15B.

After the selected presenting lever 15 has been vertically translationally moved into the proper position in the reference plane 7, the control shaft 13 is rotationally driven to rotate the selected presenting lever 15 in the reference plane 7 from a resting position A to a working position B, as follows. The upper free end of the control shaft 13 protrudes through the upper projecting member 11 of the support bracket 10, whereby the projecting member 11 is provided with an appropriate rotational bearing. The upper free end of the control shaft 13 is engaged in a connection member 30 as shown in FIGS. 1 and 2, for example, which in turn is operatively connected to a drive transmission mechanism 23 as shown in FIG. 8.

The drive transmission mechanism 23 in this illustrated embodiment is a coupling rod linkage including coupling rods 23D, 23E and 23F respectively interconnected by coupling joints 23B and 23C, and carrying a follower roller 23A on a free end of the coupling rod 23D. The arrangement further comprises a cam disk 31A mounted on a suitably provided drive shaft 31, which may, for example be a driven shaft of the loom. The follower roller 23A is held in following contact with the cam surface of the cam disk 31A by the biasing effect of a spring 32 interconnected between the coupling rod 23D and a fixed rigid machine component. As the cam disk 31A rotates in the direction of arrow 33, the rod linkage transmission mechanism 23 converts the rotational motion to a linear motion, which in turn is applied through the coupling rod 23F to the connection member 30 so as to pivotally rotate the control shaft 13. Any other drive arrangement for rotationally pivotally driving the control shaft 13 could be used instead of the coupling rod linkage transmission mechanism 23. For example, an electric motor drive can be directly connected to the control shaft 13, so as to pivotally or rockingly rotate the shaft 13 about its central axis 13A in the direction of arrow 13B.

Figure 9:
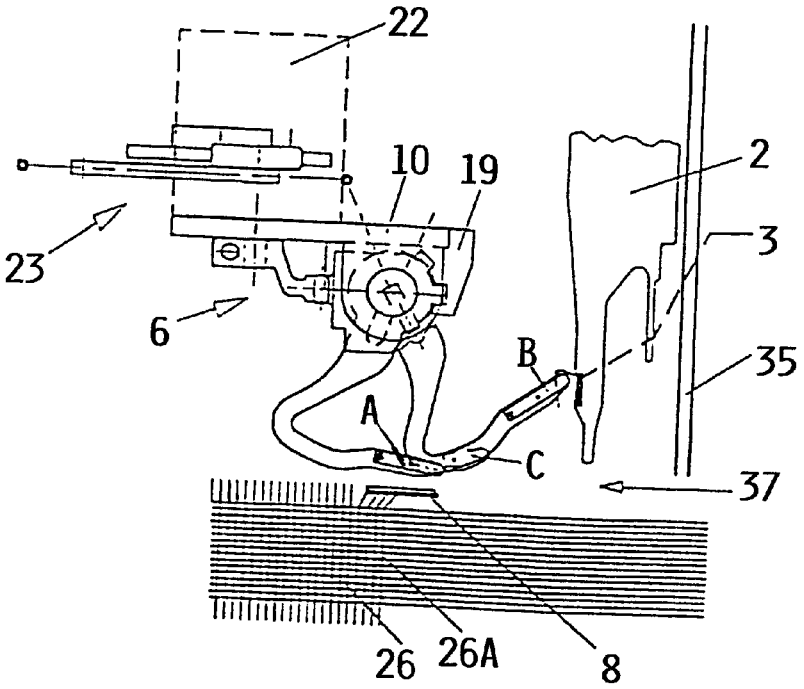
FIG. 9 is a schematic top view of the weft thread presenting and clamping arrangement according to FIG. 8.

As the shaft 13 pivotally rotates, the drive key 14 engaging in the groove 15B of the selected presenting lever 15 in the reference plane 7 rotates that selected presenting lever 15 together with the shaft 13. In this context, the rotation is carried out between the angular positions designating the resting position A and the working position B as shown in FIGS. 1 and 9. Meanwhile, the other non-selected presenting levers 15 that are not in the reference plane 7 are held stationary, i.e. do not rotate along with shaft 13. This is ensured because the shaft 13 can freely rotate in the through-holes 15A of the other presenting levers 15, because the drive key 14 does not engage these other presenting levers 15. Moreover, the guide lugs 15C of the other non-selected presenting levers 15 are held in the lengthwise groove 20 in the guide member 19, so as to prevent rotation of the other non-selected presenting levers 15. On the other hand, the guide lug 15C of the selected presenting lever 15 in the reference plane 7 moves along the crosswise groove 21 provided in the guide member 19, so as to allow the individual selected presenting lever 15 to rotate together with the control shaft 13 to which it is engaged via the key 14. The cooperation of the guide member 19, the presenting lever 15, and the control shaft 13 can be understood by viewing FIGS. 2 and 3 in combination, for example.

It should be understood that various structural arrangements other than the above mentioned grooves 20 and 21 in the guide member 19, and other than the drive key 14 engaging a groove 15B, for driving, selecting and controlling the levers 15, are within the scope of the present invention. For example, the lengthwise groove 20 may be replaced by a lengthwise spline or ridge forming the necessary linear guide, which may engage a corresponding notch in the outer periphery of the levers 15. The crosswise groove in this case would be replaced by a crosswise gap in the lengthwise spline or ridge. The rotational drive of the selected lever 15 may be achieved by engagement teeth on an outer periphery of the levers 15, rather than via the shaft 13 and its drive key 14 internally engaging the lever 15.

Figure 4:
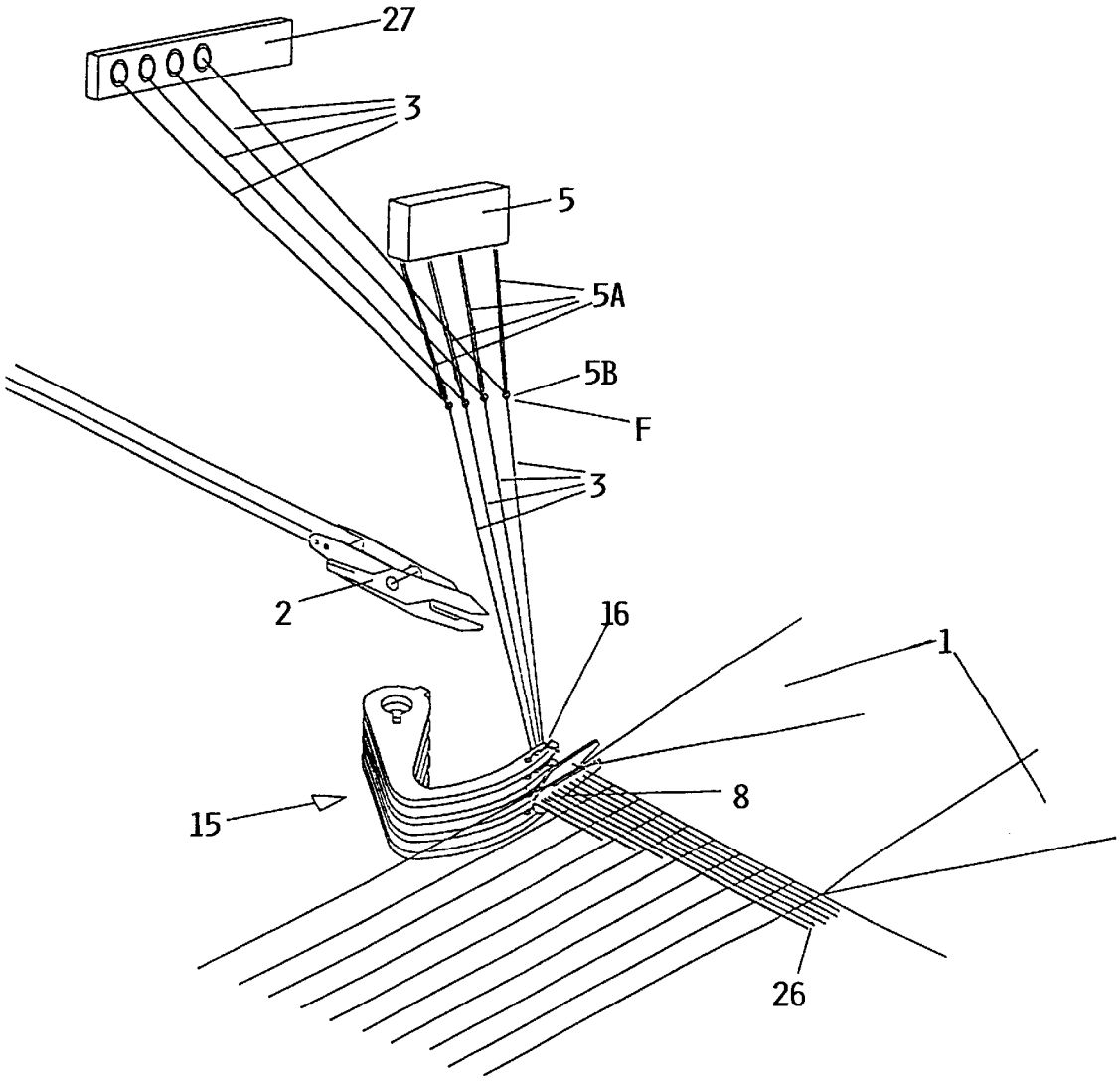
FIG. 4 is a schematic perspective illustration of the position of the thread insertion gripper before presentation of the weft thread by the weft thread presenting lever.

FIG. 4 schematically illustrates the position of the plural weft thread presenting levers 15 with their respective weft thread clamps 16 clampingly holding respective weft threads 3, relative to the loom shed 1 and other pertinent components. Note that most of the structure of the weft thread presenting and clamping arrangement has been omitted for schematic clarity. The plural weft thread presenting levers 15 are arranged stacked one above another close to or directly adjacent a weft thread cutter 8 that is arranged along the weft edge of a woven web 26. Note that the lateral or horizontal spacing distance between the weft thread cutter 8 and each of the weft thread presenting levers 15 is the same, and the presenting levers 15 are moved vertically translationally to position a selected one of the presenting levers 15 into an operating plane, i.e. the reference plane 7, for presenting a selected weft thread to an insertion gripper 2 during a respective insertion cycle. The close and uniform proximity of all of the weft thread presenting levers 15 relative to the weft thread cutter 8 is one feature that allows the weft thread waste to be minimized, and particularly uniformly minimized for each of the different weft threads 3. In order to minimize the waste of weft threads to the extent possible, the spacing between the weft thread cutter 8 and the respective weft thread clamp 16 of the selected thread presenting lever 15 is relatively small. The clamped end of the weft thread 3 is only a few millimeters long, and particularly less than 10 mm long. Namely, the spacing between the weft cutter 8 and the respective clamp 16 is less than 10 mm.

To facilitate a complete understanding of the present invention, FIG. 4 schematically shows the entire thread supply path of the weft threads 3 from the weft thread storage or supply spools 4 (see also FIG. 5), through a weft stop motion 27 arranged downstream of the weft supply spools 4, and through the weft thread selector arrangement 5. In the present example, the loom is operating with four weft threads 3, which are each respectively provided from a corresponding weft supply spool 4 through respective eyelets 5B of four respective weft thread selector needles 5A of the weft thread selector arrangement 5. For carrying out the process of presenting the selected weft thread to the insertion gripper 2, each weft thread selector needle 5A is correspondingly associated with a respective one of the weft thread presenting levers 15.

Figure 5:
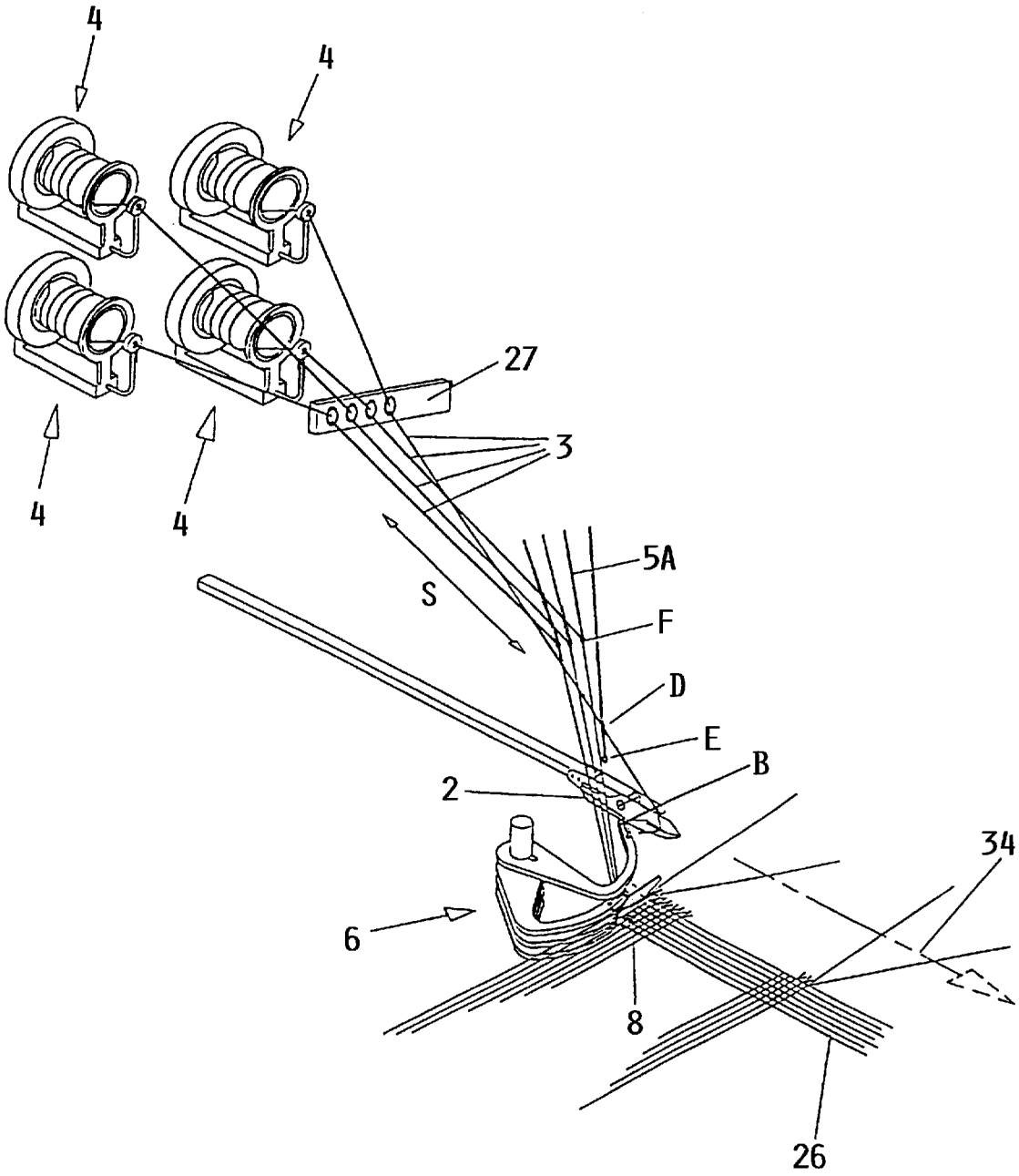
FIG. 5 is a perspective view similar to that of FIG. 4, but illustrating the position of the insertion gripper after presentation of the weft thread by the weft thread presenting lever.

The respective selected weft thread 3 is presented to the insertion gripper 2 in the reference plane 7, as shown in FIGS. 5, 8 and 9. To achieve this, the respective selected thread presenting lever 15 is rotationally moved out of a resting position A into a working position B, as shown in FIGS. 1 to 9. In this working position B, the end of the respective weft thread 3 that has been preselected by the associated weft thread selector needle 5A and has been clampingly held by the respective clamp 16 is presented and transferred to the insertion gripper 2. The path of motion of each presenting lever 15 between the resting position A and the working position B in this context corresponds to a weft thread length of at least 30 mm, which thus leads to an advantageous reduction of at least 30 mm in the waste of the weft thread per each weft thread insertion. Thus, this is another feature contributing to the reduction of thread waste.

FIG. 5 schematically shows the arrangement of FIG. 4 in a subsequent working step, whereby one selected presenting lever 15 has moved into the working position B. Similarly, one of the weft thread selector needles 5A of the selector arrangement 5 has moved out of its resting position F into its working position D. Once the selector needle 5A is in its working position D, and the corresponding presenting lever 15 is in its working position B, with the selected weft thread 3 held therebetween, the insertion gripper 2 grasps and takes over the selected weft thread 3 in or between the working positions B and D. Then the insertion gripper 2 carries the selected weft thread 3 in a direction of arrow 34 into the open loom shed 1, until approximately the middle of the loom shed 1, where the weft thread 3 is then taken over and carried the rest of the way through the loom shed 1 by a receiver gripper which is not shown.

Figure 6:
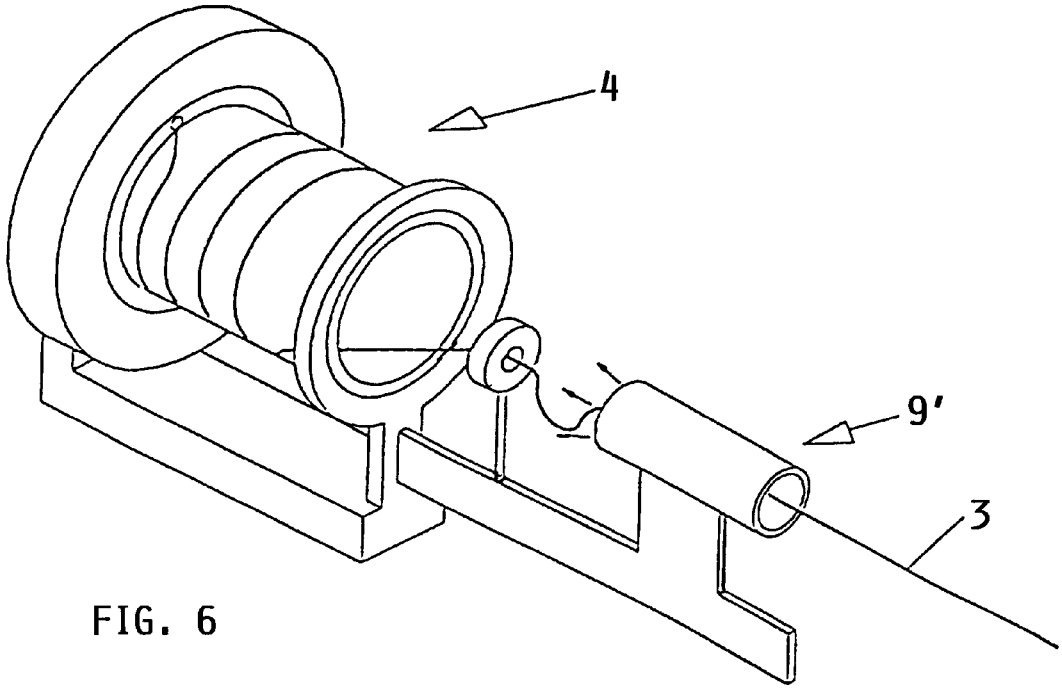
FIG. 6 is a detail perspective view of the weft thread back tensioning device as a pneumatically operating nozzle.
Figure 7:
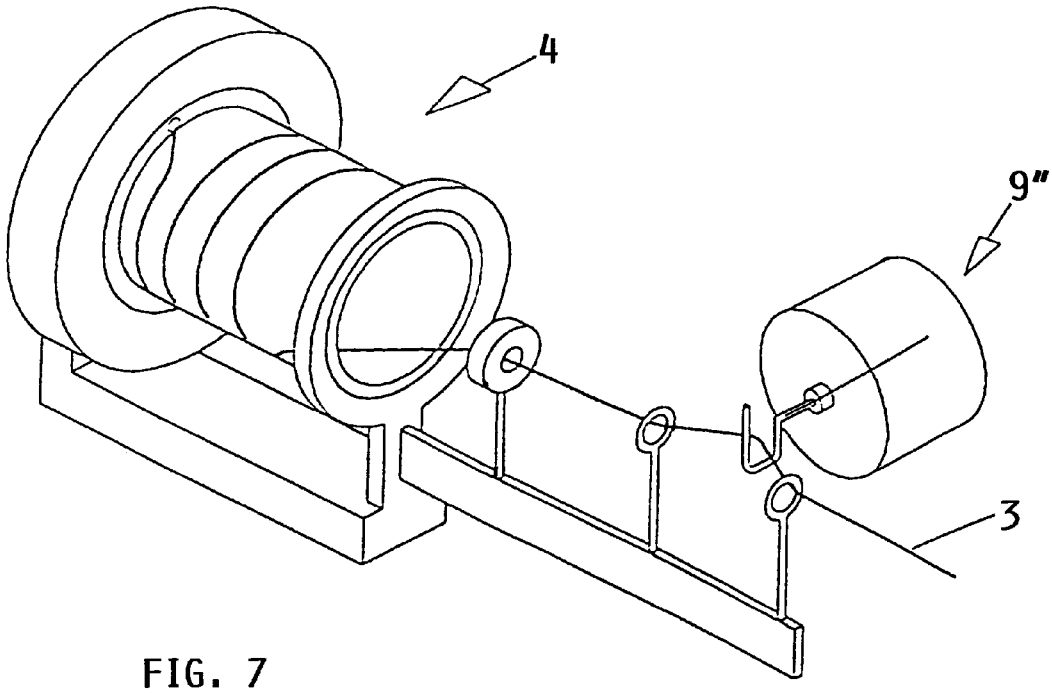
FIG. 7 is a view similar to that of FIG. 6, but showing an embodiment of the weft thread back tensioning device as an electromagnetically operating arrangement.

The path S of the weft thread 3 between the weft thread supply arrangement 4 and the weft thread selector arrangement 5 is shown in FIG. 5. FIGS. 6 and 7 show two different embodiments of a weft thread back tensioning device 9 that can be arranged in the thread path S. This device 9 carries out the function of pulling back on the respective selected weft thread 3, which is necessary to ensure that the weft thread 3 will be properly tensioned during the presentation of the weft thread by the respective selected presenting lever 15 to the insertion gripper 2, for a reliable transfer of the weft thread to the insertion gripper 2 in each case. FIG. 6 shows the weft back tensioning device 9 as a pneumatically operating nozzle arrangement, while FIG. 7 shows the weft back tensioning device 9" as an electromagnetically driven arrangement. Such devices can be embodied according to any conventional teachings. The weft back tensioning device could alternatively be embodied as a weft thread winding or looping apparatus driven by an electric motor.

As a further alternative, according to FIG. 5, the tensioning effect achieved by pulling back on the weft thread can be carried out by appropriate controlled movement of the respective associated weft thread selector needle 5A that guides the respective weft thread 3. Namely, the corresponding selector needle 5A can be moved into a tensioning position E displaced from the working or thread presenting position D. In this case, the weft thread 3 is additionally deflected over a means or member 35, which is not shown or described in detail, but is schematically indicated in FIG. 9, in order to apply the necessary tension to the presented weft thread 3 between the weft thread clamp 16 and the corresponding selector needle 5A.

FIGS. 8 and 9 schematically illustrate a drive transmission mechanism 23 for carrying out the back and forth rotating motion of the weft thread presenting levers 15 out of the resting position A, through an intermediate position C, and into the working position B. The construction and operation of this drive mechanism has already been described above, and need not be repeated here, but FIG. 9 will now be further discussed in connection with the relative positions of the various components.

For better understanding the position and motion of the thread presenting lever 15 in its position C, it should be noted as a starting point that the weft thread 3 that has been inserted into the loom shed 1 has been beaten-up against the beat-up edge 26A of the woven web 26 by the weaving reed 36. During this beat-up of the weft thread, the clamp 16 of the respective selected presenting lever 15 is located in the intermediate position C between the resting position A and the working position B. This intermediate position C is located before the beat-up edge 26A in a direction opposite the weaving direction 37. The positioning of the respective thread presenting lever 15 and particularly its thread clamp 16 into position C ensures that the weft thread 3 will be clampingly taken up by the clamp 16 in the course of the weft thread 3 being beaten up against the beat-up edge 26A, and that thereafter, for example, during movement of the presenting lever 15 with its clamp 16 into the resting position A, the weft cutter 8 will cut the weft thread 3 from the woven web 26.

Once an insertion cycle is completed, and the respective weft thread presenting lever 15 is returned from the position B, through the position C and back into the rest position A, then either the same presenting lever 15 or a different presenting lever 15 will again be moved from the rest position A through the position C and into the working position B to present the proper next weft thread 3 to the insertion gripper 2 in accordance with a desired weaving pattern that is prescribed by means of the loom control. While the illustrated example embodiment of FIGS. 4 and 5 uses four different weft threads for forming the desired weaving pattern, it is noted that FIG. 8 shows six levers 15 that may be used for up to six threads. The inventive arrangement can be used with any desired number of weft threads, by simply providing the corresponding number of thread presenting levers 15 and weft selector needles 5A. It is a relatively simply matter to mount more or fewer of the weft thread presenting levers 15 on the control shaft 13 in order to reconfigure a loom to carry out a weaving pattern with a different number of weft threads. Furthermore, a weaving pattern requiring fewer than the provided number of presenting levers 15 can be carried out without any change in the equipment, by simply using fewer than all of the available presenting levers.

Throughout this specification, the term "rotation" is to be understood as meaning or including within its meaning a rocking or pivoting rotation of less than 360°, and alternately reversing in direction. The term "axially" generally refers to a direction along or parallel to the axis of the control shaft 13, unless otherwise specified.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A weft thread presenting and clamping arrangement, comprising:

a support bracket;

a control shaft that has a shaft axis and that is supported relative to said support bracket;

a plurality of thread presenting levers with respective thread clamps arranged respectively thereon, wherein said levers are arranged adjacent one another and supported to be axially slidable along said shaft; and a guide member connected to said support bracket and including a linear guide extending parallel to said shaft axis with a gap in said linear guide at a reference plane, wherein said linear guide engages said thread presenting levers to enable said levers to slide parallel to said shaft axis along said linear guide, prevent said levers from rotating about said shaft axis relative to said linear guide at positions away from said reference plane, and enable a single selected one of said levers respectively positioned at said reference plane to rotate about said shaft axis while engaging said gap in said linear guide.

2. The weft thread presenting and clamping arrangement according to claim 1, wherein said control shaft is supported rotatably about said shaft axis relative to said support bracket, said control shaft includes a shaft body and a drive key on an outer circumferential surface of said shaft body at said reference plane, and said drive key is adapted to engage said selected thread presenting lever at said reference plane.

3. The weft thread presenting and clamping arrangement according to claim 2, further comprising:

a linear drive mechanism coupled to said thread presenting levers and adapted to slide said levers axially along said control shaft to position one of said levers as said selected lever at said reference plane; and a rotational drive mechanism coupled to said control shaft and adapted to rotate said control shaft so as to pivot said selected lever in said reference plane about said shaft axis.

4. The weft thread presenting and clamping arrangement according to claim 3, wherein each said thread presenting lever has a through-hole extending coaxially with said shaft axis and a key-engaging groove adjoining said through-hole and extending parallel to said shaft axis, wherein said outer circumferential surface of said control shaft is a cylindrical surface and said key protrudes radially outwardly therefrom, wherein said key-engaging groove is dimensioned and configured to matingly receive and engage with said key, and wherein said control shaft is arranged passing through said through-hole of each said lever and with said key engaged in said key-engaging groove of said selected lever.

5. The weft thread presenting and clamping arrangement according to claim 3, wherein said linear guide of said guide member comprises a lengthwise groove in said guide member, said gap comprises a crosswise groove in said guide member intersecting said lengthwise groove at said reference plane, and each said thread presenting lever includes a radially protruding guide lug adapted to axially slidingly engage in said lengthwise groove and adapted to selectively rotationally slidingly engage in said crosswise groove when said lever is positioned at said reference plane as said selected lever.

6. The weft thread presenting and clamping arrangement according to claim 3, wherein said support bracket includes a bracket plate and upper and lower bracket arms projecting therefrom, and wherein said control shaft is arranged extending between and is rotatably supported by said upper and lower bracket arms.

7. The weft thread presenting and clamping arrangement according to claim 3, wherein said linear drive mechanism includes a lever support member holding all of said thread presenting levers together, wherein said lever support member is arranged axially slidably on said control shaft and is adapted to slidingly move all of said levers together in unison along said control shaft, and wherein said lever support member is linearly slidably engaged with said linear guide of said guide member.

8. The weft thread presenting and clamping arrangement according to claim 7, wherein said linear drive mechanism further includes a first primary driver and a first drive transmission mechanism operatively coupling said first primary driver to said lever support member.

9. The weft thread presenting and clamping arrangement according to claim 8, wherein said first primary driver comprises a first rotational shaft, and wherein said first drive transmission mechanism comprises a toothed gear rack arranged on said lever support member, and a toothed gear sector that is connected to said first rotational shaft to rotate therewith and that is meshingly engaged with said toothed gear rack.

10. The weft thread presenting and clamping arrangement according to claim 8, wherein said first primary driver comprises a first rotational shaft, and wherein said first drive transmission mechanism comprises a first lever arm connected to said first rotational shaft to rotate therewith, and a coupling rod connected to said first lever arm and to said lever support member.

11. The weft thread presenting and clamping arrangement according to claim 3, wherein said rotational drive mechanism includes a second primary driver and a second drive transmission mechanism operatively coupling said second primary driver to said control shaft.

12. The weft thread presenting and clamping arrangement according to claim 11, wherein said second primary driver is a drive shaft adapted to be driven by a loom drive to which said drive shaft is adapted to be connected.

13. The weft thread presenting and clamping arrangement according to claim 11, wherein said second drive transmission mechanism comprises a second lever arm connected to said control shaft, and a rod linkage that includes a plurality of coupling rods interconnected by at least one coupling joint and that couples said second primary driver to said second lever arm.

14. The weft thread presenting and clamping arrangement according to claim 13, wherein said second drive transmission mechanism further comprises a cam connected to and adapted to be driven by said second primary driver, and a cam follower connected to one of said coupling rods and followingly contacting said cam.

15. The weft thread presenting and clamping arrangement according to claim 3, wherein said linear drive mechanism includes a first primary driver and a first drive transmission mechanism operatively coupling said first primary driver to said lever support member, wherein said rotational drive mechanism includes a second primary driver and a second drive transmission mechanism operatively coupling said second primary driver to said control shaft, and wherein said first and second primary drivers comprise respective electric servomotors.

16. The weft thread presenting and clamping arrangement according to claim 3, wherein said linear drive mechanism includes a first primary driver and a first drive transmission mechanism operatively coupling said first primary driver to said lever support member, wherein said rotational drive mechanism includes a second primary driver and a second drive transmission mechanism operatively coupling said second primary driver to said control shaft, and wherein said first primary driver comprises an electric servomotor and said second primary driver comprises a drive shaft adapted to be driven by a loom drive to which said drive shaft is adapted to be connected.

17. The weft thread presenting and clamping arrangement according to claim 1, wherein said reference plane is perpendicular to said shaft axis.

18. The weft thread presenting and clamping arrangement according to claim 1, wherein said thread presenting levers all respectively have a sickle shape as viewed in a direction parallel to said shaft axis.

19. A loom for forming a woven web comprising;

a weft insertion gripper adapted to insert a selected weft thread into an open shed of said woven web, a weft cutter arranged at an edge of a weaving path on a weaving plane of said loom adapted to correspond with an edge of said woven web, a read adapted to beat-up said inserted weft thread against a beat-up edge of said woven web, a multiple weft thread supply arrangement, a weft thread presenting and clamping arrangement including:

a support bracket; a control shaft that has a shaft axis and that is supported relative to said support bracket; a plurality of thread presenting levers with respective thread clamps arranged respectively thereon, wherein said levers are arranged adjacent one another and supported to be axially slidable along said shaft; and a guide member connected to said support bracket and including a linear guide extending parallel to said shaft axis with a cap in said linear guide at a reference plane, wherein said linear guide engages said thread presenting levers to enable said levers to slide parallel to said shaft axis along said linear guide, prevent said levers from rotating about said shaft axis relative to said linear guide at positions away from said reference plane, and enable a single selected one of said levers respectively positioned at said reference Plane to rotate about said shaft axis while engaging said gap in said linear guide, and a weft thread selector arrangement interposed between said multiple weft thread supply arrangement and said weft thread presenting and clamping arrangement, wherein said weft thread presenting and clamping arrangement is arranged adjacent said edge of said weaving path with said shaft axis extending perpendicular to said weaving plane and intersecting a line extending along said beat-up edge, with said thread clamps facing toward said insertion gripper, with said selected thread presenting lever adapted to be pivotally rotated about said shaft axis toward said insertion gripper from a resting position to a working position, and with said thread clamps each positioned on a vertical plane spaced not more than 10 mm from said weft cutter in said resting position of said selected thread presenting lever.

20. In a gripper loom for weaving a woven web, including a weft insertion gripper adapted to insert successive selected weft threads into an open loom shed, a plurality of weft thread supplies, a weft thread selector arrangement including a plurality of weft thread selector needles respectively receiving weft threads from said weft thread supplies, and a weft cutter arranged at an insertion side of said loom shed, an improved arrangement for minimizing waste of said weft threads, comprising:

a controllable weft thread presenting and clamping apparatus comprising a plurality of pivotally rotatable thread presenting levers carrying respective thread clamps, wherein said levers are respectively allocated to cooperate with respective corresponding ones of said selector needles, wherein said levers are vertically slidably displaceable to position a selected one of said levers into a reference plane, and said selected lever is pivotable in said reference plane from a first position (A) into a second position (B) nearer to said insertion gripper; and a respective weft thread back-tensioning device arranged in a weft thread path respectively between each thread presenting lever with said thread clamp and a corresponding one of said weft thread supplies, for holding said weft threads under tension while said weft threads are respectively presented to said insertion gripper.

21. The improved arrangement in the loom according to claim 20, wherein said second position (B) is a position of said selected lever near said insertion gripper for presenting a selected one of said weft threads to said insertion gripper, and wherein said first position (A) or a third position (C) between said first and second positions is a position of said selected lever for receiving said selected weft thread in said clamp of said selected lever.

22. The improved arrangement in the loom according to claim 20, wherein said weft thread back-tensioning device is a pneumatically operating device.

23. The improved arrangement in the loom according to claim 22, wherein said pneumatically operating device is a weft thread deflecting device.

24. The improved arrangement in the loom according to claim 22, wherein said pneumatically operating device is a controllable nozzle arrangement.

25. The improved arrangement in the loom according to claim 20, wherein said weft thread back-tensioning device is a weft thread back-winding device or a weft thread looping device driven by an electric motor.

26. The improved arrangement in the loom according to claim 20, wherein said weft thread back-tensioning device is an electromagnetically driven weft thread deflecting device.

27. The improved arrangement in the loom according to claim 20, wherein said weft thread back-tensioning device includes said selector needles and operates said selector needles so as to hold said selected weft thread under tension.

28. The improved arrangement in the loom according to claim 27, wherein said weft thread back-tensioning device is adapted to move a respective one of said selector needles receiving said selected weft thread into a tensioning position (E) different from a thread presenting position (D) of said respective selector needle for presenting said selected weft thread.

29. The improved arrangement in the loom according to claim 28, wherein said tensioning position (E) of said respective selector needle is located beyond said thread presenting position (D) in a thread presenting direction.

* * * * *